US009321566B2

(12) United States Patent
Weber et al.

(10) Patent No.: US 9,321,566 B2
(45) Date of Patent: Apr. 26, 2016

(54) BOX CLOSURE APPARATUS

(71) Applicants: Jason Weber, Lambertville, NJ (US); Arthur Weber, Flemington, NJ (US); William Weber, South Bond Brook, NJ (US)

(72) Inventors: Jason Weber, Lambertville, NJ (US); Arthur Weber, Flemington, NJ (US); William Weber, South Bond Brook, NJ (US)

(73) Assignee: Tri-Tech Tool & Design Co., Inc., South Bound Brook, NJ (US)

( * ) Notice: Subject to any disclaimer, the term of this patent is extended or adjusted under 35 U.S.C. 154(b) by 44 days.

(21) Appl. No.: 14/290,170

(22) Filed: May 29, 2014

(65) Prior Publication Data

US 2015/0344201 A1 Dec. 3, 2015

(51) Int. Cl.

| | |
|---|---|
| ***B65D 5/66*** | (2006.01) |
| ***B65D 45/00*** | (2006.01) |
| ***B65D 5/64*** | (2006.01) |
| ***B65D 5/20*** | (2006.01) |

(52) U.S. Cl.

CPC ..... *B65D 45/00* (2013.01); *B65D 5/2066* (2013.01); *B65D 5/643* (2013.01); *B65D 5/6611* (2013.01)

(58) Field of Classification Search

CPC .... B65D 45/00; B65D 5/6611; B65D 5/6647; B65D 5/2066; B65D 5/643

USPC ..... 229/125, 125.39

See application file for complete search history.

(56) References Cited

U.S. PATENT DOCUMENTS

| | | | | | |
|---|---|---|---|---|---|
| 1,176,457 | A * | 3/1916 | Jones | E05C 19/063 | 229/125.37 |
| 3,276,663 | A * | 10/1966 | Falconer | B65D 5/4283 | 229/117.23 |
| 4,019,764 | A * | 4/1977 | Okamura | F16B 5/0642 | 229/125.21 |
| 4,068,353 | A | 1/1978 | Speers et al. | | |
| 5,743,461 | A * | 4/1998 | Timmins | B65D 5/643 | 206/386 |
| 6,230,965 | B1 * | 5/2001 | Dismukes | B65D 5/643 | 229/125.39 |
| 6,290,126 | B1 | 9/2001 | Zudal | | |
| 6,571,538 | B2 | 6/2003 | Luby | | |
| 7,284,688 | B1 * | 10/2007 | Barsness | B65D 5/643 | 229/125.39 |
| 7,854,372 | B1 * | 12/2010 | Bartone, Sr. | B65D 5/4283 | 229/125.39 |
| 8,840,010 | B2 * | 9/2014 | Wilson | B65D 5/6647 | 229/125.39 |
| 2012/0255954 | A1 * | 10/2012 | Barsness | B65D 5/6605 | 220/324 |

* cited by examiner

*Primary Examiner* — Gary Elkins

(74) *Attorney, Agent, or Firm* — Bakos & Kritzer

(57) ABSTRACT

A box closure apparatus is provided for securing flaps of a box in the closed position. The box closure apparatus comprises an upper flange, a bottom flange and a web. The flaps are secured by engaging the apparatus with two flaps and sliding the apparatus toward a third flap. The flaps are released by sliding the apparatus away from the third flap and raising the two side flaps.

4 Claims, 4 Drawing Sheets

BOX CLOSURE APPARATUS

BACKGROUND

A typical box, such as one made from cardboard, has four flaps that may be independently raised and lowered to open and close the box. The box is closed by lowering each of the four flaps in order and securing the flaps in the closed position. It is generally recognized that a box may be closed by overlapping the flaps in succession, where each flap is positioned over the adjacent flap, or in the alternative by folding down opposite-positioned flaps, and then adhering them using tape, adhesive, staples, or other adhering means. To open a secured box, the flaps must be unsecured and lifted. If the flaps are overlapped, affixed using adhesive, or held closed with staples, one must apply enough force to bend the flaps or overcome the adhesive or staples in order to open the box. If the flaps are held closed with tape, then the tape must be cut or removed before the flaps can be opened. In each of the foregoing arrangements, the flaps or the walls of the box may be damaged in the process of opening the box due to the force necessary to pull the flaps open, or due to the need to utilize a sharp tool to cut the tape. In addition, it is presently difficult to close and open boxes repeatedly. Use of the foregoing methods for closing and opening a box causes wear on the flaps and walls of the box, which reduces the overall strength and stability of the box. For example, each time cardboard flaps are folded to overlap each other, the cardboard is structurally weakened. Similarly, each time tape is applied to a cardboard box to seal it closed and then removed to open the box again, the cardboard tends to lose an outer layer of its fibrous material. If the tape is cut to open the box flaps, the tape remains on the cardboard flaps and walls. This reduces the effectiveness of the next application of tape when the box is closed again. Thus, there exists a need to secure box flaps in the closed position to allow the box flaps to be closed, opened, reclosed and reopened without great effort and without risking damage to the box.

SUMMARY

The box closure apparatus disclosed herein is designed to secure the flaps of a box in the closed position. Further, the box closure apparatus of the present invention is designed to allow a box to be frequently and easily closed and opened, without causing damage to box flaps, or resulting in box instability. In the preferred embodiment, the apparatus comprises a top flange having a first set of wings, a bottom flange having a second set of wings and a web having center ridges. The apparatus is designed such that said first and second sets of wings engage the box flaps in the closed position such that the box flaps provide structural support, preventing the box flaps from opening or falling into the box.

To secure the flaps of a box in the closed position, two oppositely located flaps are closed such that the edges of the flaps extend between the top flange and the bottom flange of the apparatus. One remaining flap, the "end flap," is then lowered such that it may rest on top of the two side flaps. A user then places the apparatus of the present invention adjacent to the remaining flap and slides the apparatus toward the end flap until the end flap is located between the top flange and the bottom flange of the box closure apparatus. As a result, the box closure apparatus is positioned such that the three aforementioned box flaps are secured between the top flange and the bottom flange. In this position, the box closure apparatus prevents each flap from rotating vertically, and thus the flaps are secure enough to be transported without fear of the box opening and the contents spilling out. To release the flaps, the box closure apparatus is removed laterally away from the end flap until the end flap no longer extends between the top flange and the bottom flange of the apparatus. The end flap and side flaps may then be lifted and the apparatus removed, allowing access to the box contents.

BRIEF DESCRIPTION OF THE DRAWINGS

The detailed description makes reference to the accompanying figures wherein.

Other objects, features, and characteristics of the present invention, as well as methods of operation and functions of the related elements of the structure and the combination of parts, will become more apparent upon consideration of the following detailed description with reference to the accompanying drawings, all of which form part of this specification.

DETAILED DESCRIPTION OF THE PREFERRED EMBODIMENT

A detailed illustrative embodiment of the present invention is disclosed herein. However, techniques, methods, processes, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

None of the terms used herein, including "clip," "flange," "wing," "web," "ridge," "box" and "flap" are meant to limit the application of the invention. Any reference to a box is exemplary and intended to encompass a box, carton, package or other container. Any reference to a "flap" is exemplary and is intended to encompass a box flap as well as other substantially planar rotatable surfaces, or any other method of securing a container's contents. The terms are used to illustrate the preferred embodiment and are not intended to limit the scope of the invention. Similarly, the use of any term is not meant to limit the scope or application of the invention, as the invention is versatile and can be utilized in connection with many applications, as will be apparent to one of ordinary skill in the art from the present disclosure. The following presents a detailed description of the preferred embodiment of the present invention with reference to the figures.

Figure 1:
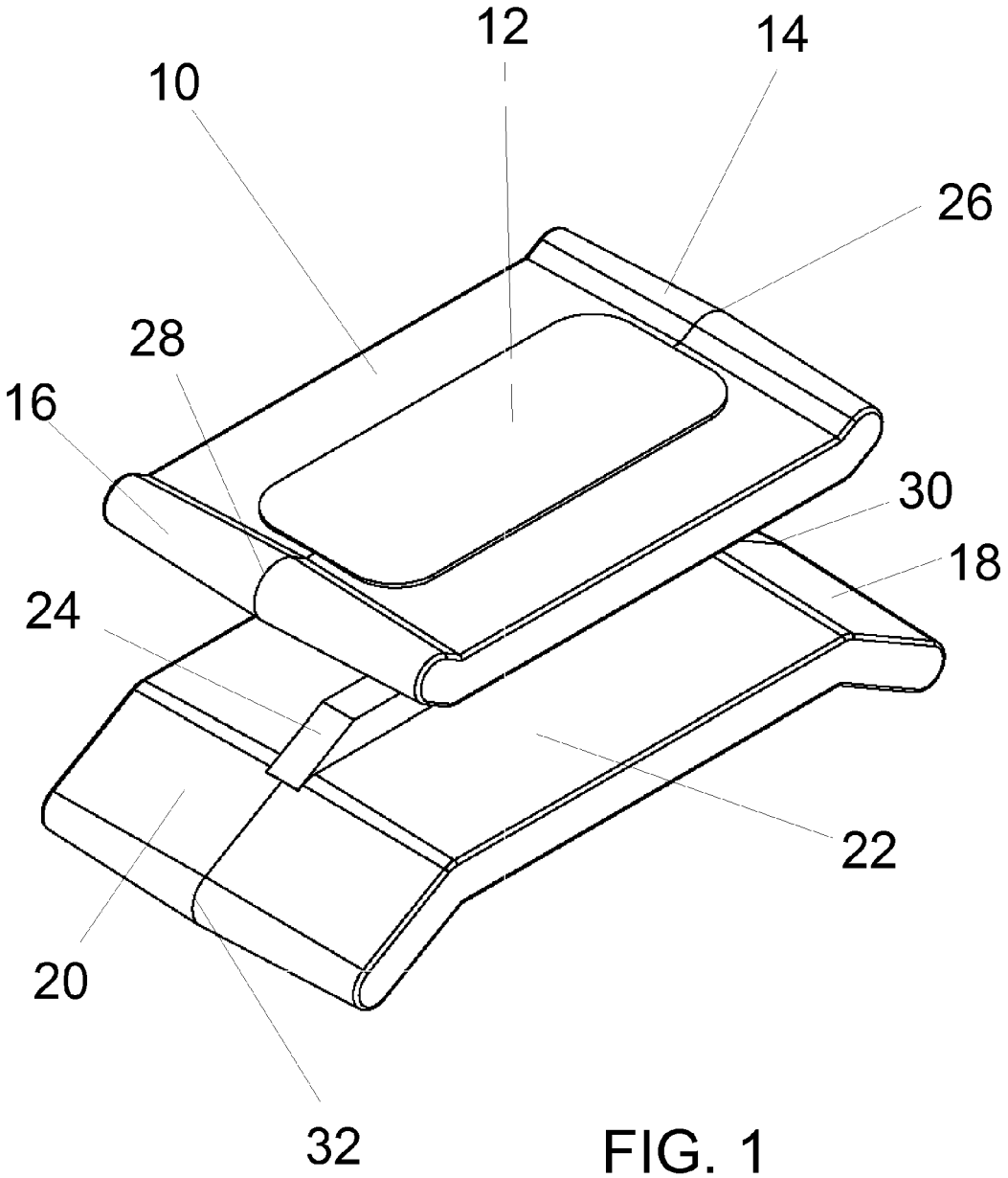
FIG. 1 illustrates a perspective view of a box closure apparatus according to the preferred embodiment of the present invention.

Disclosed herein is a box closure apparatus (or clip) for removably securing flaps of a box, carton, package or other container in a closed position. With reference to FIG. 1, shown is an apparatus in accordance with the preferred embodiment. The apparatus comprises top flange 10 with first upper wing 14 and second upper wing 16. First upper wing 14 and second upper wing 16 preferably extend at least at a slight upward angle from top flange 10, as shown in FIG. 1, but may alternatively extend straight outward or at least at a downward angle from top flange 10. First center line 26 indicates the midpoint of the width of first upper wing 14. In the preferred embodiment, first upper wing 14 is gradually angled away from first center line 26. In alternative embodiments, the angle and shape of first upper wing 14 in relation to first center line 26 may be varied without departing from the principles disclosed herein and without departing from the scope of the invention disclosed herein. Second center line 28 indicates the midpoint of the width of second upper wing 16. In the preferred embodiment of the present invention, second upper wing 16 is formed as a mirror image of first upper wing 14. In alternative embodiments, the angles and shapes of first upper wing 14 and second upper wing 16 may be varied independently of one another without departing from the spirit of the present invention or the disclosure herein. In yet another alternative embodiment, first upper wing 14 and second upper wing 16 may be omitted without departing from the scope of the present invention. Top flange 10 optionally also comprise name plate 12, which may be used to display information such as the owner, manufacturer, or distributor of the box closure apparatus. Name plate 12 may also be optionally utilized to display third party advertising. In alternative embodiments, any surface of the apparatus may be used to display information, design or advertising.

With further reference to FIG. 1, the box closure apparatus comprises bottom flange 22 having first lower wing 18 and second lower wing 20. First lower wing 18 and second lower wing 20 are preferably angled at least at a downward angle from bottom flange 22, as shown in FIG. 1, but may alternatively extend straight outward or at least at an upward angle from bottom flange 22. Third center line 30 indicates the center of first lower wing 18. In the preferred embodiment, first lower wing 18 is gradually angled away from third center line 30. In alternative embodiments, the angle and shape of first lower wing 18 may be varied without departing from the principles disclosed herein. Fourth center line 32 indicates the center of second lower wing 20. In the preferred embodiment, second lower wing 20 is formed as a mirror image of first lower wing 18. In alternative embodiments, the angles and shapes of first lower wing 18 and second lower wing 20 may be varied independently of each other. In yet another alternative embodiment, first lower wing 18 and second lower wing 20 may be omitted.

In the preferred embodiment, the surfaces of the box closure apparatus are substantially smooth which facilitates sliding the apparatus along the surfaces of the box flaps. It should be appreciated that one or more surfaces of the apparatus may comprise rough, sticky, coarse, glossy or other textures and finishes. In addition, one or more surfaces of the apparatus may comprise protrusions to engage the box flaps and secure the apparatus in place. Optional protrusions, including for example bumps or barbs, may be disposed on the underside of top flange 10, first upper wing 14 or second upper wing 16, the upper surface of bottom flange 22, first lower wing 18 or second lower wing 20, or the surfaces of web 34, first center ridge 24 or second center ridge 36 to facilitate gripping flaps of a box.

Figure 2:
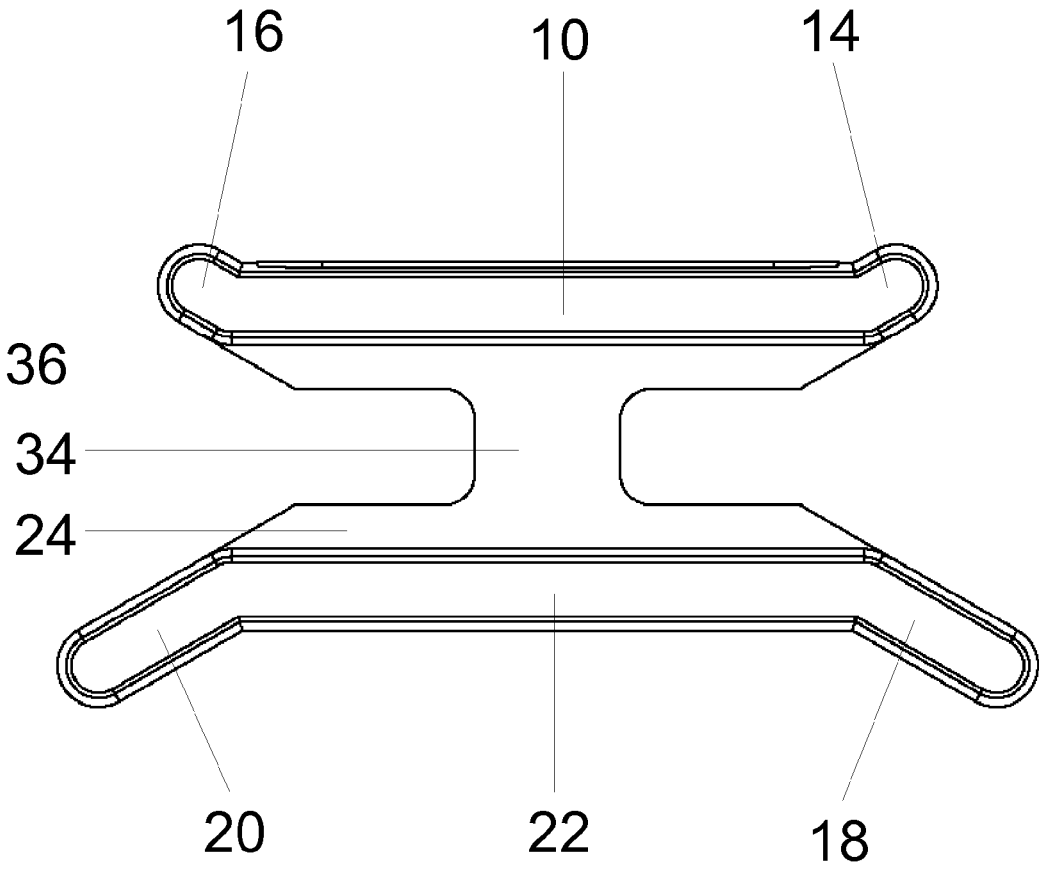
FIG. 2 illustrates a front view of a box closure apparatus according to the preferred embodiment of the present invention.

FIG. 2 depicts a side view of the box closure apparatus in accordance with the preferred embodiment. Top flange 10 and bottom flange 22 are connected by web 34. Web 34 is preferably a vertical member positioned between the horizontal top flange 10 and horizontal bottom flange 22. Web 34 comprises first center ridge 24 and second center ridge 36 which extend outwardly from the center of web 34. In an alternative embodiment, first center ridge 24 and second center ridge 36 are omitted.

Figure 3:
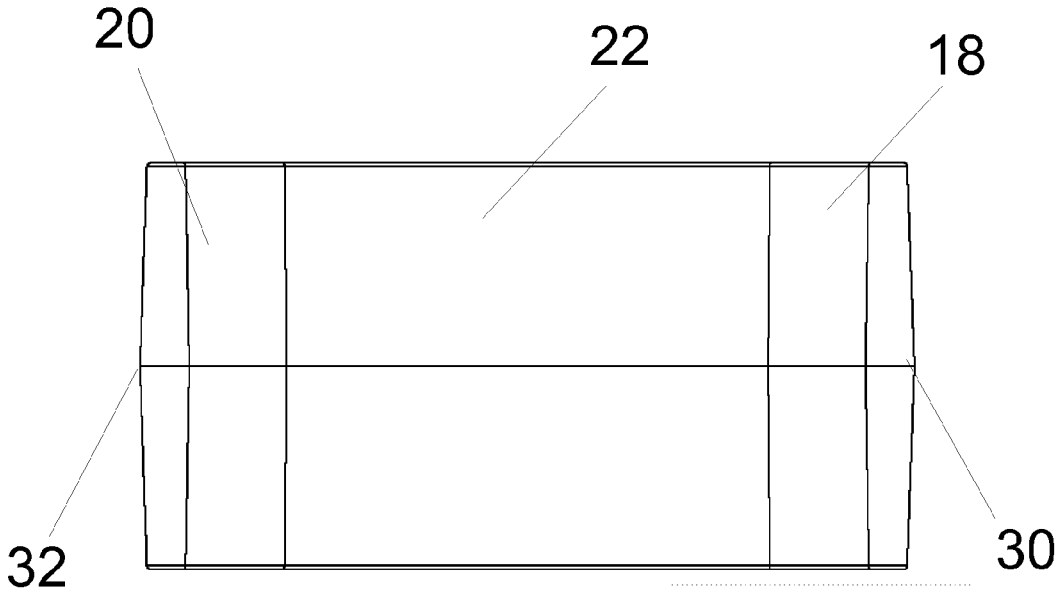
FIG. 3 illustrates a bottom view of a box closure apparatus according to the preferred embodiment of the present invention.

FIG. 3 depicts a bottom view of the box closure apparatus in accordance with the preferred embodiment. Shown are bottom flange 22, first lower wing 18 and second lower wing 20. As depicted, first lower wing 18 is angled inward from third center line 30, and second lower wing 20 is angled inward from fourth center line 32.

Figure 4:
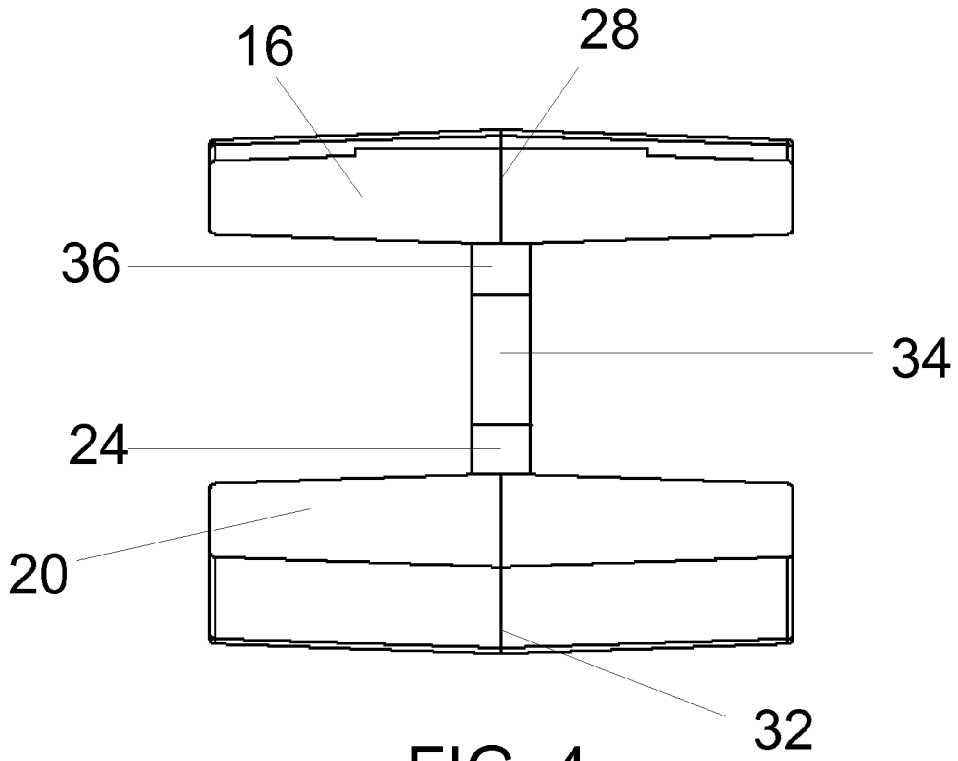
FIG. 4 illustrates a side view of a box closure apparatus according to the preferred embodiment of the present invention.

FIG. 4 depicts a side view of the box closure apparatus in accordance with the preferred embodiment. Shown are second upper wing 16 with second center line 28, second lower wing 20 with fourth center line 32, and web 34 with first center ridge 24 and second center ridge 36. As shown, web 34 is narrower than second upper wing 16 and second lower wing 20. Referring back to FIG. 1, web 34 is also narrower than top flange 10 and bottom flange 22.

Figure 5:
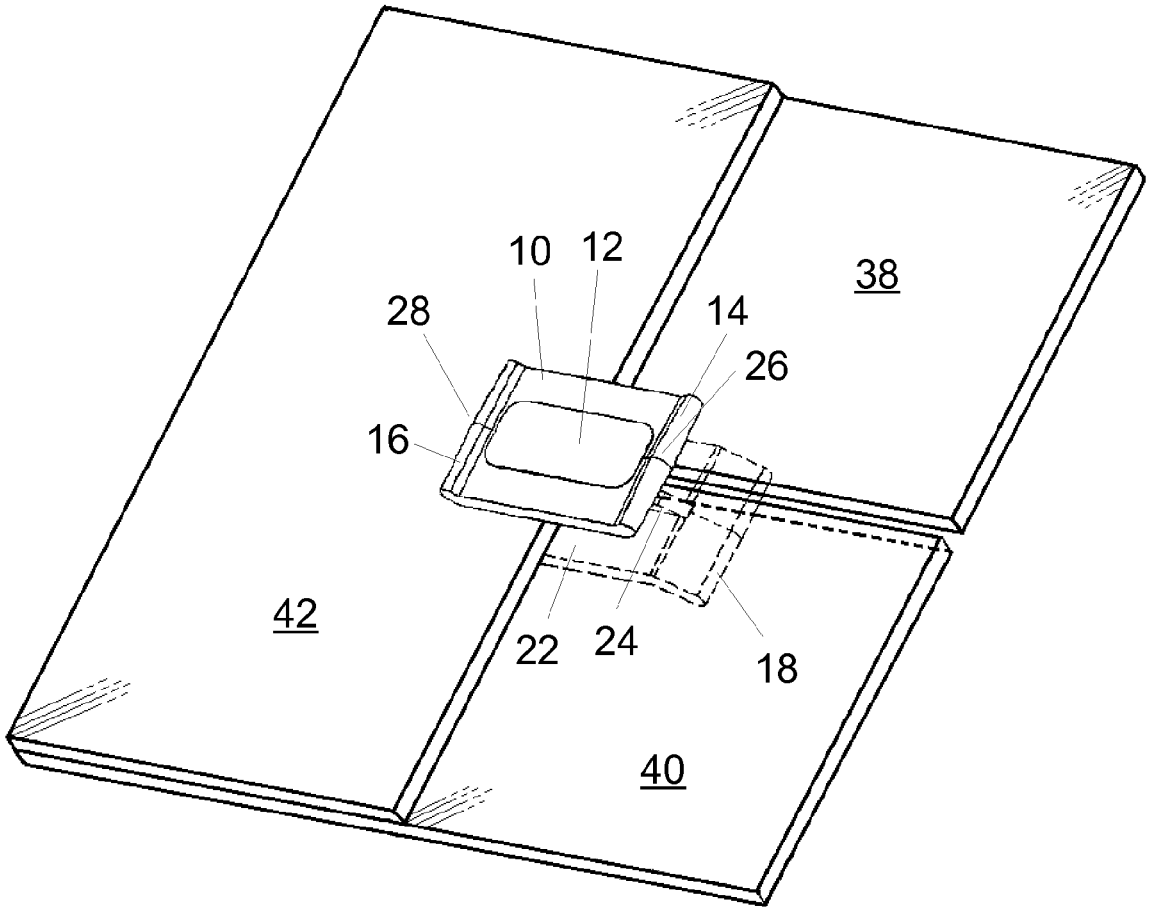
FIG. 5 illustrates a perspective view of a box closure apparatus engaged with the flaps of a box according to the preferred embodiment of the present invention.

FIG. 5 depicts the preferred box closure apparatus of the present invention securing three flaps of a box in accordance with the preferred embodiment. In this position, top flange 10 sits above first side flap 38, second side flap 40 and end flap 42. Bottom flange 22 is located below first side flap 38, second side flap 40 and end flap 42. Web 34 (not shown in FIG. 5) is located between first side flap 38 and second side flap 40. The left side of first center ridge 24 extends below end flap 42, and the left side of second center ridge 36 (not shown in FIG. 5) extends above end flap 42. In this configuration, the box closure apparatus secures first side flap 38, second side flap 40 and end flap 42 in the closed position, and is structurally supported by first side flap 38, second side flap 40 and end flap 42. It should be appreciated by those of ordinary skill in the art that first center ridge 24 and second center ridge 36 provide a smaller area for end flap 42 than would otherwise exist between top flange 10 and bottom flange 22. This smaller area allows the apparatus to engage end flap 42 more snugly, thereby providing more stability to the apparatus, the box flaps, and the box itself.

To engage the apparatus of the present invention with first side flap 38, second side flap 40 and end flap 42 as shown in FIG. 5, a user begins with the box flaps in their open or raised position. The user then places the apparatus between open first side flap 38 and open second side flap 40, and the first side flap 38 and second side flap 40 are closed so that they extend between the top flange 10 and bottom flange 22. First side flap 38 and second side flap 40 are now separated by web 34. End flap 42 is then lowered to its closed position. The apparatus is then slid towards end flap 42 until end flap 42 extends between top flange 10 and bottom flange 22. Preferably, the apparatus is slid towards end flap 42 until end flap 42 extends between first center ridge 24 and second center ridge 36. The result is the placement of the apparatus as shown in FIG. 5. In this position, end flap 42 is held firmly between first center ridge 24 and second center ridge 36. To disengage the apparatus from the box flaps, the apparatus is slid away from end flap 42 until it is clear of the edge of end flap 42. Then end flap 42 is raised to its open position, and first side flap 38 and second side flap 40 are raised to their open position. The foregoing steps may be used to repeatedly secure box flaps in the closed position and then release them to the open position without compromising the strength or structure of the box.

It should be appreciated that the end flap of a box may be lowered before the side flaps are lowered, so that the end flap is below the side flaps. In this embodiment, the side flaps are closed so that they extend between the top flange and bottom flange of the apparatus and are separated by the web. The apparatus is then slid toward the end flap until the end flap is positioned between the top flange and the bottom flange, and preferably between the two center ridges of the apparatus.

It is contemplated that the box closure apparatus may be used to hold all four flaps of a box closed. In this embodiment, the flaps are closed so that the end of each flap is positioned between the top flange and bottom flange of the apparatus. In addition, the end flaps are preferably positioned between the two center ridges of the apparatus.

The box closure apparatus in accordance with the preferred embodiment has been described with reference to a four-sided box. It should be appreciated that the apparatus may be used with alternatively shaped boxes, including for example triangular boxes, without departing from the principles disclosed herein. In addition to boxes, the apparatus may be used with other containers comprising flaps, and may be used with boxes and containers comprising cardboard or other materials. The apparatus may comprise plastic, wood, metal, other materials or a combination thereof without departing from the principles disclosed herein.

While the present invention has been described with reference to the preferred embodiment, which has been set forth in considerable detail for the purposes of making a complete disclosure of the invention, the preferred embodiment is merely exemplary and is not intended to be limiting or represent an exhaustive enumeration of all aspects of the invention. The scope of the invention, therefore, shall be defined solely by the claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A box closure apparatus, comprising:

a substantially rectangular top flange having a first width and a first length;

a substantially rectangular bottom flange having a second width and a second length;

a web substantially orthogonal to the top flange and the bottom flange, said web coupled to the top flange and the bottom flange, said web having a third width and a third length;

wherein the web comprises a first center ridge coupled to the top flange, the first center ridge having a fourth length substantially equal to the first length of the top flange, the first center ridge having a fourth width substantially equal to the third width of the web;

wherein the web comprises a second center ridge coupled to the bottom flange, said second center ridge having a fifth length substantially equal to the second length of the bottom flange, said second center ridge having a fifth width substantially equal to the second width of the web; and wherein the first width of the top flange and the second width of the bottom flange are larger than the third width of the web, and wherein the first length of the top flange and the second length of the bottom flange are larger than the third length of the web.

2. The box closure apparatus of claim 1, further comprising:

a first wing extending from said top flange; and a second wing extending from said top flange.

3. The box closure apparatus of claim 2, further comprising:

a third wing extending from said bottom flange; and a fourth wing extending from said bottom flange.

4. The box closure apparatus of claim 3, wherein one or more surfaces of the top flange, the bottom flange, the web, the first center ridge, the second center ridge, the first wing, the second wing, the third wing and the fourth wing comprise one or more of the following: bumps, ridges, protrusions, and adhesive.

* * * * *